US009542788B2

(12) United States Patent
Kecht

(10) Patent No.: US 9,542,788 B2
(45) **Date of Patent: *Jan. 10, 2017**

(54) VALUE DOCUMENT AND METHOD FOR CHECKING THE PRESENCE OF THE SAME

(71) Applicant: GIESECKE & DEVRIENT GMBH, München (DE)

(72) Inventor: Johann Kecht, München (DE)

(73) Assignee: GIESECKE & DEVRIENT GMBH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/023,597

(22) PCT Filed: Sep. 29, 2014

(86) PCT No.: PCT/EP2014/002643
§ 371 (c)(1),
(2) Date: Mar. 21, 2016

(87) PCT Pub. No.: WO2015/043761
PCT Pub. Date: Apr. 2, 2015

(65) Prior Publication Data

US 2016/0232735 A1 Aug. 11, 2016

(30) Foreign Application Priority Data

Sep. 27, 2013 (DE) ..... 10 2013 016 134

(51) Int. Cl.
*G07D 7/20* (2016.01)
*B42D 25/30* (2014.01)
(Continued)

(52) U.S. Cl.
CPC ..... *G07D 7/2041* (2013.01); *B42D 25/29* (2014.10); *B42D 25/30* (2014.10); *B42D 25/378* (2014.10);
(Continued)

(58) Field of Classification Search
CPC ..... G06K 9/00046; G06K 9/00013; A61B 5/1172; G07D 7/12; G07D 7/122
See application file for complete search history.

(56) References Cited

U.S. PATENT DOCUMENTS 4,376,264 A 3/1983 Dokter et al.
4,533,244 A * 8/1985 Kaule ..... B41M 3/144 250/271
(Continued)

FOREIGN PATENT DOCUMENTS

DE 19518086 A1 11/1996
DE 102004027416 A1 12/2005
(Continued)

OTHER PUBLICATIONS

International Search Report from corresponding PCT Application No. PCT/EP2014/002643, May 7, 2015.
(Continued)

*Primary Examiner* — Tarifur Chowdhury
*Assistant Examiner* — Md M Rahman
(74) *Attorney, Agent, or Firm* — Workman Nydegger

(57) ABSTRACT

The invention concerns a value document comprising particulate agglomerates respectively containing at least two different homogeneous phases, wherein the first homogeneous phase is based on a first non-luminescent substance detectable by a spectroscopic method and the second homogeneous phase is based on a second non-luminescent substance detectable by a spectroscopic method, and wherein upon an evaluation of measurement values that are obtainable by a location-specific measurement, carried out at different locations of the value document, of the first measurement-signal intensity caused by the first substance and underlying the spectroscopic method and the second measurement-signal intensity caused by the second substance and underlying the spectroscopic method, there is a statis-
(Continued)

tical correlation between the first measurement-signal intensities and the second measurement-signal intensities.

14 Claims, 4 Drawing Sheets

(51) Int. Cl.

| | |
|---|---|
| ***B42D 25/29*** | (2014.01) |
| ***B42D 25/378*** | (2014.01) |
| ***G07D 7/06*** | (2006.01) |
| ***G07D 7/04*** | (2016.01) |
| ***G07D 7/12*** | (2016.01) |

(52) U.S. Cl.
CPC *G07D 7/04* (2013.01); *G07D 7/06* (2013.01); *G07D 7/12* (2013.01)

(56) References Cited

U.S. PATENT DOCUMENTS

| | | | | |
|---|---|---|---|---|
| 4,863,783 | A | 9/1989 | Milton | |
| 5,149,946 | A | 9/1992 | Jerome et al. | |
| 5,324,567 | A | 6/1994 | Bratchley et al. | |
| 5,853,464 | A | 12/1998 | MacPherson et al. | |
| 7,067,824 | B2 * | 6/2006 | Muller | G06K 19/14 250/458.1 |
| 8,871,299 | B2 | 10/2014 | Kecht et al. | |
| 2003/0132538 | A1 | 7/2003 | Chandler | |
| 2004/0031931 | A1 * | 2/2004 | Muller | G06K 19/14 250/458.1 |
| 2004/0183004 | A1 * | 9/2004 | Niggemann | G06K 19/10 250/271 |
| 2007/0165209 | A1 | 7/2007 | Natan et al. | |
| 2008/0163994 | A1 | 7/2008 | Hoppe et al. | |
| 2009/0258200 | A1 | 10/2009 | Scholz et al. | |
| 2011/0228264 | A1 | 9/2011 | Tam | |
| 2012/0156491 | A1 | 6/2012 | Tam et al. | |
| 2012/0237668 | A1 | 9/2012 | Kecht et al. | |
| 2013/0009119 | A1 | 1/2013 | Natan et al. | |

FOREIGN PATENT DOCUMENTS

| | | | |
|---|---|---|---|
| DE | 102005019980 | A1 | 11/2006 |
| DE | 102005047609 | A1 | 4/2007 |
| EP | 0775324 | A2 | 5/1997 |
| EP | 1826730 | A2 | 8/2007 |
| EP | 2505619 | A1 | 10/2012 |
| WO | 9605522 | A2 | 2/1996 |
| WO | 02085543 | A1 | 10/2002 |
| WO | 03014700 | A2 | 2/2003 |
| WO | 2005113705 | A1 | 12/2005 |
| WO | 2006053685 | A2 | 5/2006 |
| WO | 2006072380 | A2 | 7/2006 |
| WO | 2008028476 | A2 | 3/2008 |
| WO | 2010135351 | A1 | 11/2010 |
| WO | 2011066948 | A1 | 6/2011 |

OTHER PUBLICATIONS

Press et al., "Numerical Recipes in C: The Art if Scientific Computing," Cambridge University press, 2nd Edition,1997, pp. 628-645.

Storm, "Probability theory, mathematical statistics and statistical quality control," Carl Hanser Verlag, 12th edition, 2007, pp. 246-285.

International Preliminary Report on Patentability from corresponding PCT Application No. PCT/EP2014/002643, Mar. 29, 2016.

* cited by examiner

VALUE DOCUMENT AND METHOD FOR CHECKING THE PRESENCE OF THE SAME

BACKGROUND

This invention concerns a value document such as a bank note, and a method for checking the presence of the same.

Safeguarding the authenticity of value documents by means of luminescent substances has been known for some time. Preferably, host lattices doped with rare earth metals are used, with the absorption and emission regions being variable within a broad range through suitable coordination of rare earth metal and host lattice. It is also per se known to employ magnetic and electrically conductive materials for safeguarding authenticity. Magnetism, electrical conductivity and luminescence emission are detectable by machine using commercially available measuring instruments, while luminescence with emission in the visible region in sufficient intensity is also detectable visually.

Practically as old as safeguarding the authenticity of value documents is the problem of the value documents' authentication features being forged. Anti-forgery security can be increased for example by employing not only one feature substance, but a plurality of feature substances in combination, for example a luminescent substance and a magnetic substance, or a luminescent substance and a substance influencing the luminescence properties. DE 10 2005 047 609 A1 describes feature substances for safeguarding the authenticity of value documents which contain a luminescent substance and at least one further substance that is preferably magnetic or electrically conductive. The luminescent substance is present in particulate form and is surrounded by a shell formed of nanoparticles. The properties of the feature substance result from the interaction of the luminescence emission properties of the luminescent substance and the properties of the nanoparticles.

Starting out from this prior art, the present invention is based on the object of providing a value document that is improved in terms of anti-forgery security, and a method for checking the presence of the same.

SUMMARY OF THE INVENTION 1. (First aspect of the invention) A value document comprising particulate agglomerates respectively containing at least two different (in particular solid) homogeneous phases, wherein the first homogeneous phase is based on a first non-luminescent substance detectable by a spectroscopic method and the second homogeneous phase is based on a second non-luminescent substance detectable by a spectroscopic method. Upon an evaluation of measurement values that are obtainable by a location-specific measurement, carried out at different locations of the value document, of the first measurement-signal intensity caused by the first substance and underlying the spectroscopic method and the second measurement-signal intensity caused by the second substance and underlying the spectroscopic method, there is a statistical correlation between the first measurement-signal intensities and the second measurement-signal intensities.
2. (Preferred embodiment) The value document according to item 1, wherein the spectroscopic method suitable for the detectability of the first non-luminescent substance and the spectroscopic method suitable for the detectability of the second non-luminescent substance are identical, wherein preferably the exciting electromagnetic radiation of the spectroscopic method is radio-wave, microwave, terahertz or infrared radiation.
3. (Preferred embodiment) The value document according to item 2, wherein the non-luminescent substance of the first (in particular solid) homogeneous phase and the non-luminescent substance of the second (in particular solid) homogeneous phase are chosen from the following five kinds of substance, namely, a substance detectable by nuclear magnetic resonance spectroscopy, a substance detectable by electron spin resonance spectroscopy, a substance detectable by nuclear quadrupole resonance spectroscopy, a substance detectable by SER (surface-enhanced Raman) spectroscopy and a substance detectable by SEIRA (surface-enhanced infrared absorption) spectroscopy, on the condition that the kind of non-luminescent substance of the first homogeneous phase is identical with the kind of non-luminescent substance of the second homogeneous phase.
4. (Preferred embodiment) The value document according to item 1, wherein the first spectroscopic method suitable for the detectability of the first non-luminescent substance and the second spectroscopic method suitable for the detectability of the second non-luminescent substance are different, wherein preferably the exciting electromagnetic radiation of the first spectroscopic method and the exciting electromagnetic radiation of the second spectroscopic method are chosen from the following four kinds of radiation, radio-wave, microwave, terahertz and infrared radiation, on the condition that the kind of exciting electromagnetic radiation of the first spectroscopic method is different from the kind of exciting electromagnetic radiation of the second spectroscopic method.
5. (Preferred embodiment) The value document according to item 4, wherein the non-luminescent substance of the first homogeneous phase and the non-luminescent substance of the second homogeneous phase are chosen from the following five kinds of substance, namely, a substance detectable by nuclear magnetic resonance spectroscopy, a substance detectable by electron spin resonance spectroscopy, a substance detectable by nuclear quadrupole resonance spectroscopy, a substance detectable by SER (surface-enhanced Raman) spectroscopy and a substance detectable by SEIRA (surface-enhanced infrared absorption) spectroscopy, on the condition that the kind of non-luminescent substance of the first homogeneous phase is different from the kind of non-luminescent substance of the second homogeneous phase.
6. (Preferred embodiment) The value document according to any of items 1 to 5, wherein the agglomerates are chosen from the group consisting of core-shell particles, particle agglomerates, encapsulated particle agglomerates and nanoparticle-encased particles.

A preferred combination is offered by particle agglomerates having a first homogeneous phase which is detectable by a SER spectroscopy and a second homogeneous phase which is detectable by a SER spectroscopy, wherein the exciting electromagnetic radiation of the spectroscopic method is infrared radiation.

A further preferred combination is offered by encapsulated particle agglomerates having a first homogeneous phase which is detectable by a SER spectroscopy and a second homogeneous phase which is detectable by a SER spectroscopy, wherein the exciting electromagnetic radiation of the spectroscopic method is infrared radiation.

A further preferred combination is offered by particle agglomerates having a first homogeneous phase which is detectable by a SER spectroscopy and a second homogeneous phase which is detectable by a SEIRA spectroscopy, wherein the exciting electromagnetic radiation of the spectroscopic method is infrared radiation.

Further preferred combinations are particle agglomerates having a first homogeneous phase which is detectable by a SER spectroscopy and a second homogeneous phase which is detectable by nuclear magnetic resonance spectroscopy or by electron spin resonance spectroscopy or by nuclear quadrupole resonance spectroscopy. In particular, in the case of the SER spectroscopy the exciting radiation is infrared radiation, in the case of the nuclear magnetic resonance spectroscopy or nuclear quadrupole resonance spectroscopy the exciting radiation is in the radio wavelength region, in the case of the electron spin resonance spectroscopy the exciting radiation is in the radio wavelength to microwave-length region.

7. (Preferred embodiment) The value document according to any of items 1 to 6, wherein the particulate agglomerates have a grain size D99 in a range of 1 micrometer to 100 micrometers, preferably 5 micrometers to 30 micrometers, particularly preferably in a range of 10 micrometers to 20 micrometers.

8. (Preferred embodiment) The value document according to any of items 1 to 7, wherein, in addition to the particulate agglomerates, there is incorporated into or applied to the value document in uniform concentration a non-correlating correction component which luminesces at a certain emission wavelength or is detectable separately with one of the spectroscopic methods.

9. (Second aspect of the invention) A method for checking the presence or the authenticity of a value document according to any of items 1 to 7 comprising:

a) exciting the non-luminescent substance, detectable by a spectroscopic method, of the first (in particular solid) homogeneous phase and exciting the non-luminescent substance, detectable by a spectroscopic method, of the second (in particular solid) homogeneous phase;

b) spatially resolved capturing of measurement values for the first measurement-signal intensities and second measurement-signal intensities deriving from the non-luminescent substances and underlying the respective spectroscopic method, in order to generate first measurement-signal intensity/location measurement-value pairs and second measurement-signal intensity/location measurement-value pairs;

c) checking whether there is a statistical correlation between the first measurement-signal intensities and the second measurement-signal intensities.

According to one embodiment, for rating the authenticity of a value document a statistical correlation function is computed for the obtained measurement values and its amount compared with a threshold value. In particular, with a correlation function normalized in terms of amount to a values range of 0 to 1, an existing statistical correlation and thus authenticity is recognized when the amount is >0.3, preferably >0.5, and particularly preferably >0.7.

According to a further embodiment, for rating the authenticity of a value document one can proceed as follows: In a first step, the measuring data for the first measurement-signal intensities and second measurement-signal intensities deriving from the non-luminescent substances and underlying the respective spectroscopic method are obtained. In a second step, the measuring data are normalized. In a third step, there is effected a transformation of the axes of coordinates, preferably a rotation by 45°, in order to minimize the scattering of the data points along an axis of coordinates. In a fourth step, there are determined the quantiles in the direction of the two new axes of coordinates, preferably the quartiles, and their mutual distances or differences are put in a ratio. By a comparison of said ratio with previously determined threshold values the authenticity of the value document is determined.

10. (Third aspect of the invention) A method for checking the presence or the authenticity of a value document according to any of items 1 to 7 comprising:

a) exciting the non-luminescent substance, detectable by a spectroscopic method, of the first (in particular solid) homogeneous phase and exciting the non-luminescent substance, detectable by a spectroscopic method, of the second (in particular solid) homogeneous phase;

b) spatially resolved capturing of measurement values for the first measurement-signal intensities and second measurement-signal intensities deriving from the non-luminescent substances and underlying the respective spectroscopic method, at at least one location of the value document;

c) checking whether the ratio of the measurement values that is measured for the first and second measurement-signal intensities at the at least one location of the value document lies within a certain values range.

11. (Fourth aspect of the invention) A method for checking the presence or the authenticity of a value document according to any of items 1 to 7 comprising:

a) exciting the non-luminescent substance, detectable by a spectroscopic method, of the first (in particular solid) homogeneous phase in one or more of the particulate agglomerates;

b) exciting the non-luminescent substance, detectable by a spectroscopic method, of the second (in particular solid) homogeneous phase in one or more of the particulate agglomerates, with the examined particulate agglomerates being identical with the particulate agglomerates examined in a);

c) checking whether the at least one examined particulate agglomerate has both the measurement signal of the first non-luminescent substance and the measurement signal of the second non-luminescent substance.

12. (Preferred embodiment) The method according to item 11, wherein for checking the properties of the luminescent substance and/or of the non-luminescent substance one or more microscope setups are used.

13. (Preferred embodiment) The method according to any of items 9 to 12, wherein the measurement values for the first measurement-signal intensities and second measurement-signal intensities deriving from the non-luminescent substances and underlying the respective spectroscopic method are converted into corrected measurement values in an intermediate step. In particular, there are employed for this purpose further measurement values of a non-correlating correction component incorporated into the value document in uniform concentration, said component luminescing at a certain emission wavelength or being detectable separately with one of the spectroscopic methods.

14. (Preferred embodiment) The method according to any of items 9 to 13, wherein only those measurement values for the first measurement-signal intensities and second measurement-signal intensities deriving from the non-luminescent substances and underlying the respective spectroscopic method that respectively lie within a certain values range, in particular above a certain threshold value, are drawn on for determining authenticity.

According to one embodiment, the measurement values of locations in the immediate neighborhood of the measurement values below the certain threshold value are also not drawn on for determining authenticity.

DETAILED DESCRIPTION OF THE INVENTION

Figure 1:
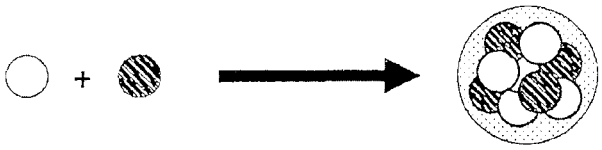
FIG. 1 schematically shows the incorporation of a plurality of particulate agglomerates.

Value documents within the context of this invention are objects such as bank notes, checks, shares, value stamps, identity cards, passports, credit cards, deeds and other documents, labels, seals, and objects to be safeguarded such as CDs, packages and the like. The preferred area of application is bank notes which are in particular based on a paper substrate.

Luminescent substances are standardly used for safeguarding bank notes. In the case of a luminescent authentication feature or security feature which is e.g. incorporated in the paper of a bank note at different places, the luminescence signals of the feature are naturally subject to certain fluctuations at the different places.

Besides authentication features on the basis of luminescent substances, there are further authentication features based on non-luminescent substances which can be detected by spectroscopic methods. Kinds of spectroscopy can be subdivided e.g. according to the excitation energy of the electromagnetic radiation. Thus, nuclear magnetic resonance spectroscopy (NMR) is based on an exciting electromagnetic radiation with a wavelength in a range of 1 m to 100 m, i.e. radio waves. Electron spin resonance spectroscopy (ESR) is based on an exciting electromagnetic radiation with a wavelength in a range of 1 cm to 1 m. Microwave spectroscopy is based on an exciting electromagnetic radiation with a wavelength in a range of 1 mm to 10 cm. Submillimeter wave spectroscopy is based on an exciting electromagnetic radiation with a wavelength in a range of 100 μm to 1 mm (also known under the name of terahertz radiation). Vibrational spectroscopy, in particular Raman spectroscopy, further in particular SER (surface-enhanced Raman) spectroscopy or SERR (surface-enhanced resonant Raman) spectroscopy, is based in particular on an exciting electromagnetic radiation with a wavelength in a range of 200 nm to 3 μm, preferably in a range of 780 nm to 3 μm, i.e. near infrared radiation. Infrared spectroscopy, in particular SEIRA (surface-enhanced infrared absorption), is based on an exciting wavelength in the range of 800 nm to 1 mm, preferably 3 μm to 1 mm, i.e. mid and far infrared radiation.

The present invention is based on the finding that a targeted generation of mixed, particulate agglomerates from a first non-luminescent substance, on the one hand, and a second non-luminescent substance, on the other hand, which are respectively detectable spectroscopically results in the effect of a statistical correlation of the intensity fluctuations of the measurement-signal intensities of the two substances. In this manner it is possible to distinguish the samples according to the invention by evaluating the agglomerate-induced signal correlation of non-correlating authentication features. Non-correlating authentication features are in particular the mixtures of two different non-luminescent, spectroscopically detectable substances which are respectively untreated and powdery.

In other words, it is the basic principle of the present invention that two or more substances with different measurable properties are combined in a single particle. As a result, the relative intensities of the measurement signals are coupled with each other, so that security features based on such particles can be distinguished e.g. from a simple mixture of the single particles of the two or more substances.

Utilization of the above effect leads to an increase in anti-forgery security, because non-correlating feature signals can be recognized as "false". Furthermore, the number of possible encodings can be increased. There can thus be additionally generated from an encoding containing two individual non-luminescent feature substances A and B and a luminescent or non-luminescent feature substance C, by means of a targeted particulate agglomeration of two and three of the feature substances in each case, the four distinguishable variants (A+B),C/A,(B+C)/(A+C),B/(A+B+C), where the signals of the substances within a bracket respectively correlate with each other.

The particulate agglomerates according to the invention respectively contain at least two different solid homogeneous phases, wherein the first solid homogeneous phase is based on a first non-luminescent substance detectable by a spectroscopic method (hereinafter also designated as "first non-luminescent feature substance") and the second solid homogeneous phase is based on a second non-luminescent substance detectable by a spectroscopic method (hereinafter also designated as "second non-luminescent feature substance"). The exciting electromagnetic radiation of the spectroscopic method can have in particular a wavelength in a range of 200 nm to 100 m, preferably 780 nm to 100 m.

According to a preferred embodiment, the particulate agglomerates are not configured to be planar or wafer-like but rather three-dimensionally extended, in particular spherical or spheroidal (e.g. elliptical) or fractal. This impedes a direct analysis of the different solid homogeneous phases with simple methods such as by light microscopy.

In particular, the designation "non-luminescent feature substance" means that the spectroscopically detectable feature substance is not a luminescent pigment as is typically used in the prior art for safeguarding bank notes and other value documents.

The adhesion of the two substances present in the form of solid homogeneous phases must be sufficiently strong that during storage and processing there is no separation of the two substances, at least not to an extent that will disturb the manufacture of security features.

The particulate agglomerates according to the invention may involve in particular core-shell particles, particle agglomerates, encapsulated particle agglomerates or nanoparticle-encased particles. Particle agglomerates and encapsulated particle agglomerates are particularly preferred. The shell or capsule can be based on an inorganic or organic material (e.g. inorganic oxide or organic polymer). A shell consisting of inorganic oxides, e.g. $SiO_2$, is preferred.

The agglomerates are preferably manufactured by a special method in which the different security features (i.e. the different non-luminescent substances) are intermixed with low shear forces in a salty aqueous solution and subsequently an aqueous silicate solution added. The silicate solution is neutralized by an acid source likewise added or already contained in the aqueous salt solution, and combines the single particles of the security features into firm agglomerates through the arising $SiO_2$.

Furthermore, more than two kinds of security features can be combined in one agglomerate. Likewise, an agglomerate can contain single particles of two or more security features (luminescent or non-luminescent) and additionally single particles of one or more inactive materials which are not security features themselves.

The non-luminescent substance, detectable by a certain spectroscopic method, of the first and the second solid homogeneous phase of the particulate agglomerate is preferably a substance detectable by nuclear magnetic resonance spectroscopy (NMR), nuclear quadrupole resonance spectroscopy (NQR), electron spin resonance spectroscopy (ESR), SER (surface-enhanced Raman) spectroscopy or SEIRA (surface-enhanced infrared absorption) spectroscopy. The abbreviation SER refers to surface-enhanced Raman scattering. The abbreviation SEIRA refers to surface-enhanced infrared absorption.

The non-luminescent substance detectable by NMR spectroscopy will hereinafter also be designated as "NMR-active substance" or "NMR tag". The non-luminescent substance detectable by ESR spectroscopy will hereinafter also be designated as "ESR-active substance" or "ESR tag". The non-luminescent substance detectable by NQR spectroscopy will hereinafter also be designated as "NQR-active substance" or "NQR tag". The non-luminescent substance detectable by SER spectroscopy will hereinafter also be designated as "SERS-active substance" or "SERS tag".

The non-luminescent substance of the first solid homogeneous phase and the non-luminescent substance of the second solid homogeneous phase can be chosen in particular from the following five kinds of substance, namely, a substance detectable by nuclear magnetic resonance spectroscopy, a substance detectable by electron spin resonance spectroscopy, a substance detectable by nuclear quadrupole resonance spectroscopy, a substance detectable by SER (surface-enhanced Raman) spectroscopy and a substance detectable by SEIRA (surface-enhanced infrared absorption) spectroscopy, on the condition that the kind of non-luminescent substance of the first solid homogeneous phase is identical with the kind of non-luminescent substance of the second solid homogeneous phase. The two non-luminescent substances (e.g. NMR substance 1 and NMR substance 2) must differ with respect to the signal position of the measurement signal.

According to one alternative, the non-luminescent substance of the first solid homogeneous phase and the non-luminescent substance of the second solid homogeneous phase are chosen from the following five kinds of substance, namely, a substance detectable by nuclear magnetic resonance spectroscopy, a substance detectable by electron spin resonance spectroscopy, a substance detectable by nuclear quadrupole resonance spectroscopy, a substance detectable by SER (surface-enhanced Raman) spectroscopy and a substance detectable by SEIRA (surface-enhanced infrared absorption) spectroscopy, on the condition that the kind of non-luminescent substance of the first solid homogeneous phase is different from the kind of non-luminescent substance of the second solid homogeneous phase (e.g. an NMR substance and a SERS substance).

The particulate agglomerate can be e.g. so constituted that NMR tags and SERS tags are conjoined in the form of a particle agglomerate. If a simple mixture of NMR tags and SERS tags were introduced into the (paper) substrate of a value document, the two kinds of particle could be randomly distributed in the substrate. With such a random distribution there is no relation between the measured NMR signals and the measured SERS signals. If, on the other hand, an agglomerate of both kinds of particle is introduced into the substrate of a value document, the two signals correlate with each other. Places with relatively high NMR signals will likewise show elevated SERS signals, and places with relatively low NMR signals will likewise show reduced SERS signals.

The conjoining of the two substances within a single particle is to prevent a segregation of the two substances. For example, with a simple mixture of very different particles, such as NMR tags sized 5 to 10 μm and SERS tags sized 100 nm, there can be a different insertion behavior e.g. into a paper substrate. This includes accumulation at different places (e.g. on the paper fiber surface or in fiber interstices through different surface charge of the particles), a different dispersion behavior (e.g. lumping of the SERS tags in water), different retention properties (e.g. varying degrees of retaining power in the paper mat of a paper machine), or a mechanical segregation (e.g. a size separation through shaking motions during transport of a container with powdery feature substances). All these factors can have the result that upon a check of a place of the value document the two kinds of substance are present in very different quantities and only one of the two substance classes can be found in a sufficient quantity for enabling an authenticity check. This is disadvantageous in particular when a certain mutual ratio of the two different signals is assumed as the authenticity criterion. Conjoining the two kinds of substance in a single particle, on the other hand, guarantees similar insertion into the substrate.

The evaluation of the colocality of the two signal types, i.e. the simultaneous occurrence of both signal types at one location to a corresponding extent, can theoretically be effected here in different ways. In the case of quickly measurable, machine-readable features, a mathematical correlation of the fluctuating feature intensities at a multiplicity of small-area measurement sites is possible. Upon measurement by a hand-held unit, there can be ascertained e.g. a fixed intensity ratio of the two signals on a relatively large measuring area. Upon measurement e.g. by a means of microscope setup, a forensic detection can be effected by a single found particle showing the properties of both single substances (e.g. NMR signal and SERS signal). "Microscope setup" means here that the measuring instrument employed for examination is able, e.g. through a high spatial resolution in the measuring field, to check individual or only few particles with respect to the property to be measured.

The application of ESR-active substances as a security feature for bank notes, inter alia, is known in the prior art (see e.g. U.S. Pat. Nos. 4,376,264 A, 5,149,946 A and DE 195 18 086 A).

EP 0 775 324 B1 describes the use of substances as a security feature that are excited without additionally applied electrical or magnetic fields ("zero field") via resonance in the high-frequency region. These include in particular NQR-active substances.

Particulate security features on the basis of microwave absorbers are described e.g. in EP 2 505 619 A1.

The utilization of special particles as a security feature for detection by Raman spectroscopy, in particular by SERS, is known from, inter alia, the prints WO 2008/028476 A2, US 2013/0009119 A1, US 2012/0156491 A1, US 2011/0228264 A1, US 2007/0165209 A1, WO 2010/135351 A1, U.S. Pat. No. 5,853,464 A, WO 02/085543 A1 and U.S. Pat. No. 5,324,567 A.

Encapsulating or encasing luminescent substances in a polymer shell or silicate shell or the like is known e.g. from WO 2011/066948 A1, US 2003/0132538 A1 and WO 2005/113705 A1.

As mentioned hereinabove, according to a preferred embodiment there can be additionally generated from an encoding containing two individual non-luminescent feature substances A and B and a luminescent feature substance C, by means of a targeted particulate agglomeration of two and three of the feature substances in each case, the four distinguishable variants (A+B),C/A,(B+C)/(A+C),B/(A+B+C), where the signals of the substances within a bracket respectively correlate with each other. The luminescent substance can in particular be excited to luminescence emission, preferably phosphorescence emission, by radiation in the infrared and/or visible and/or ultraviolet region. The luminescent substance can be a substance emitting in the visible or in the non-visible spectral region (e.g. in the UV or NIR region). Luminescent substances emitting in the NIR region are preferred (the abbreviation NIR standing for near infrared). The luminescent substance can be based e.g. on a matrix-forming inorganic solid which is doped with one or more rare earth metals or transition metals. The luminescent substance will hereinafter also be designated as "luminophore particle". Suitable inorganic solids that are suitable for forming a matrix are for example:

- oxides, in particular tri- and tetravalent oxides such as titanium oxide, aluminum oxide, iron oxide, boron oxide, yttrium oxide, cerium oxide, zirconium oxide, bismuth oxide, as well as more complex oxides such as garnets, including e.g. yttrium iron garnets, yttrium aluminum garnets, gadolinium gallium garnets;
- perovskites, including yttrium aluminum perovskite, lanthanum gallium perovskite;
- spinels, including zinc aluminum spinels, magnesium aluminum spinels, manganese iron spinels; or mixed oxides such as ITO (indium tin oxide);
- oxyhalides and oxychalcogenides, in particular oxychlorides such as yttrium oxychloride, lanthanum oxychloride; as well as oxysulfides, such as yttrium oxysulfide, gadolinium oxysulfide;
- sulfides and other chalcogenides, e.g. zinc sulfide, cadmium sulfide, zinc selenide, cadmium selenide;
- sulfates, in particular barium sulfate and strontium sulfate;
- phosphates, in particular barium phosphate, strontium phosphate, calcium phosphate, yttrium phosphate, lanthanum phosphate, as well as more complex phosphate-based compounds such as apatites, including calcium hydroxyl apatites, calcium fluorapatites, calcium chlorapatites; or spodiosites, including e.g. calcium fluorospodiosites, calcium chlorospodiosites;
- silicates and aluminosilicates, in particular zeolites such as zeolite A, zeolite Y; zeolite-related compounds such as sodalites; feldspars such as alkali feldspars, plagioclases;
- further inorganic compound classes such as vanadates, germanates, arsenates, niobates, tantalates.

The principle underlying the invention will be described in detail hereinafter in connection with FIGS. 1 to 4:

When safeguarding bank notes with security features on the basis of luminescent substances (like the above-mentioned inorganic matrices doped with rare earth metals or transition metals) or on the basis of non-luminescent substances, it is frequently sufficient to incorporate a relatively small quantity of the feature. The mass fractions can lie in particular in the per mill range. When such a feature is incorporated into the paper of a bank note in a greatly diluted form, however, the spatial distribution of the pigments particles is not perfectly homogeneous under normal circumstances. With a purely random distribution of the pigment particles in the sheet pulp there are naturally regions with higher and lower particle concentrations. This can become apparent through e.g. intensity fluctuations upon measurement of the luminescence intensity or the measurement-signal intensity based on a certain spectroscopic method at different places of the bank-note substrate.

It is known in the prior art to use encodings consisting of two or more luminescent substances as a security feature to increase security. Intensity fluctuations that are based on the random distribution of the pigment particles within the sheet pulp are independent of each other here. There is thus no relation between the random, location-dependent intensity fluctuations of two different feature substances. It is to be noted that this does not hold for inhomogeneities of the paper itself, e.g. in the case of locally different paper thicknesses. In this case, fluctuations of the luminescence intensity, e.g. low values at thinner places in the paper, would affect both feature substances to the same extent. Through a suitable choice of the security features and as low a concentration in the substrate as possible, substrate-induced fluctuations relative to the fluctuations induced by the random particle distribution can often be neglected (or be eliminated through suitable evaluation methods). An analogous behavior results with the simultaneous use of different non-luminescent feature substances in the paper substrate.

Another picture results, however, with the combination of two different feature substances, e.g. a first non-luminescent feature substance and a second non-luminescent feature substance, into a particulate agglomerate (see FIG. 1). For example, a particulate agglomerate obtained by agglomerating a mixture of the features substances "A" and "B" would combine both feature-substance types.

Figure 2:
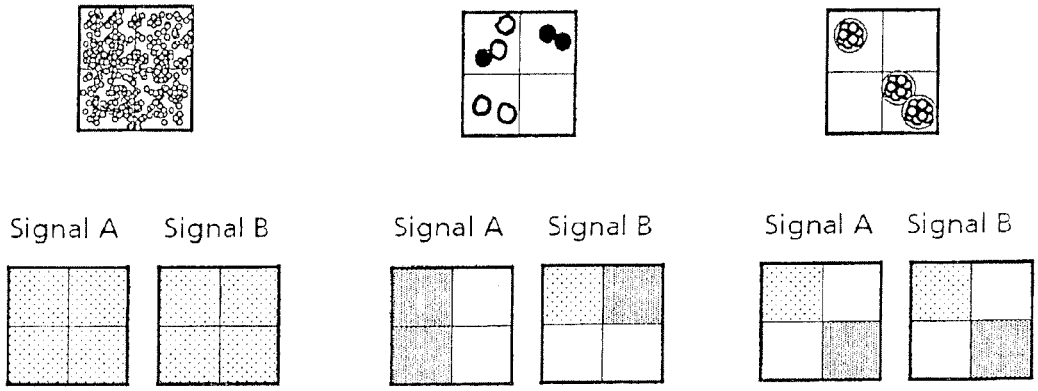
FIG. 2 schematically shows measurement-signal intensities of features substances compared at four places in a paper substrate.
Figure 3:
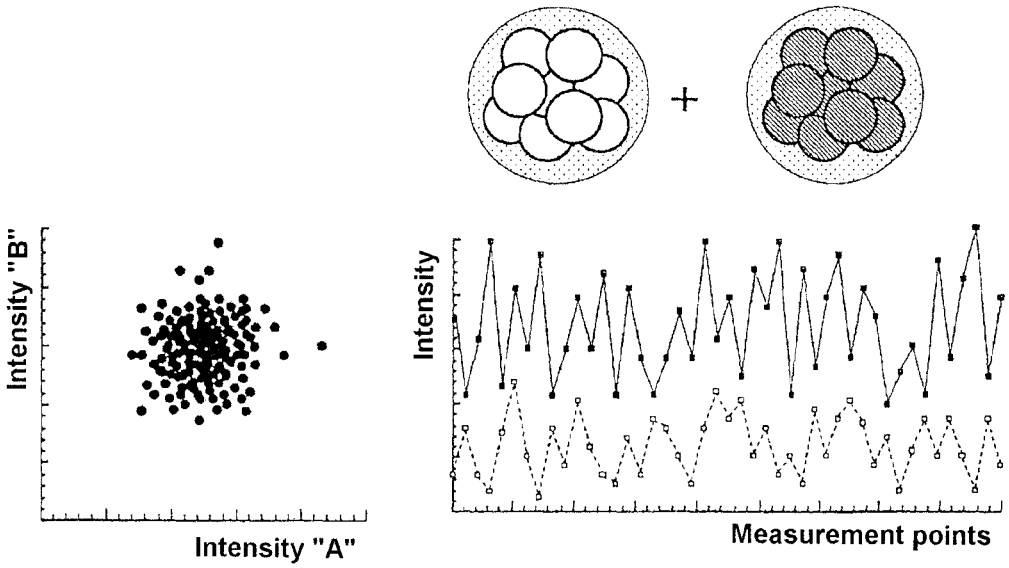
FIG. 3 schematically shows signals of substances fluctuating independently of each other.

Upon the incorporation of a plurality of particulate agglomerates shown in FIG. 1 into paper, and a random distribution in the paper pulp, a relation between the spatial distributions of the features substances "A" and "B" would arise independently of the substrate (see FIG. 2).

In FIG. 2, the measurement-signal intensities of the feature substances "A" and "B" are schematically compared at four places in a paper substrate, with the densely dotted areas symbolizing high signal intensities and the less densely dotted areas symbolizing less high signal intensities.

FIG. 2 Left:

Feature substances "A" and "B" respectively having a low measurement-signal intensity are used in high quantity. This leads to low fluctuations of the measurement-signal intensity in the individual regions. "Signal A" and "signal B" are always similarly strong.

FIG. 2 Middle:

Feature substances "A" and "B" respectively having a high measurement-signal intensity (which can be achieved e.g. by adjusting the particle size to larger particles, or by employing pure-substance agglomerates) are used in low quantity. This has the consequence that some regions yield a high "signal A" and some regions have a high "signal B". Between the two signals there is no relation, i.e. no statistical correlation. The term "pure-substance agglomerate" refers to an agglomerate having only particles of a single particle type.

FIG. 2 Right:

Particulate agglomerates that are obtainable from particles "A" and particles "B" are used. The starting substances A and B can respectively have a high or a low intensity. There result regions with elevated "signal A" and at the same time elevated "signal B", and regions with low "signal A" and at the same time low "signal B". In other words, there is a statistical correlation between the two signals.

The relation between "signal A" and "signal B" shown in FIG. 2 on the right is not necessarily directly proportional. The particulate agglomerates consist ideally, but not necessarily, of 50% particles A and 50% particles B. It is possible that a manufacturing method leads to particulate agglomerates with a statistical internal distribution of feature substances A and B. For example, there can arise agglomerate compositions that consist on average of ten feature-substance particles and contain agglomerates with a composition "5A+5B", but also "3A+7B" and "7A+3B", etc. Thus, it is possible e.g. that at a measurement position of the paper substrate where a high local concentration of agglomerates is present, an especially strong signal of substance "A" is measured but the signal of substance "B" is not significantly elevated. However, this is unlikely, statistically speaking. If there is a local accumulation or depletion of the agglomerates one will likely find an accumulation or depletion of the signals of "A" and "B" to a certain degree. The signals therefore correlate with each other. For further explanation of this correlation, there follows Application example 1:

Application Example 1:

Mixed agglomerates of a non-luminescent feature substance "A" and a non-luminescent feature substance "B" were manufactured. For comparison, the agglomerates "only A" and the agglomerates "only B" were manufactured. Then a paper sheet with 2 wt. ‰ of the mixed agglomerates of "A" and "B" was prepared in a sheet former. Furthermore, a paper sheet with a mixture of 1 wt. ‰ "only A" and 1 wt. ‰ "only B" was prepared. Spectroscopic examination yields that the signals of substance "A" and substance "B" are respectively recognizable in both sheets at the same wavelength and with comparable intensity. A conventional sensor would thus ascertain no difference between the two sheets and recognize both as "identical" or "authentic". However, additionally heeding the mutual correlation of the two signals of "A" and "B" one can recognize distinct differences between the sheets. For this purpose, the sheets were measured on an apparatus that automatically checks the signal strength of the two features A and B simultaneously at a plurality of measurement positions. To increase the number of data points, a plurality of places on the sheet were measured and evaluated. In the case of the sheet with the two "pure" substances, the signals of "A" and "B" fluctuate independently of each other (see FIG. 3). When the intensities of "A" and "B" are plotted against each other graphically, a round point cloud hence arises. In the case of the sheet with the mixed agglomerates, a dependence of the signal fluctuations is recognizable (see FIG. 4). When the intensities of "A" and "B" are plotted against each other graphically, one recognizes a point distribution stretched along the axial diagonals. The point distribution indicates a correlation between the signal strength of the two components.

Figure 4:
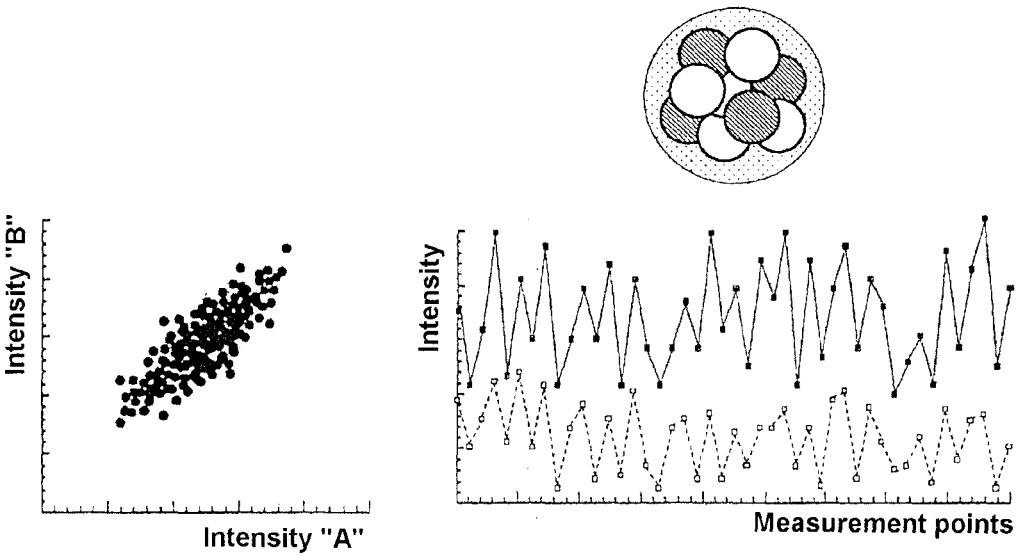
FIG. 4 schematically shows a dependence of signal fluctuations.

If the normalized signal intensities of "A" and "B" were identical at all measurement positions of the paper substrate, the point distribution represented in FIG. 4 would ideally represent a line. This behavior is frequently not to be found in reality due to the statistical composition of the agglomerates, because for such a behavior all agglomerates would have to possess a fixed ratio of e.g. exactly 50% "A" fraction and exactly 50% "B" fraction. However, in practice it is possible to produce such systems or an approximation to this condition, e.g. by (1) an electrostatic preference of the heterogeneous agglomeration, or (2) a massive increase of the particle number per agglomerate, or (3) by employing nanoparticles, or (4) by controlled build-up of core-shell systems with defined sizes.

Due to the correlation the ratio of the intensities between "A" and "B" at arbitrary places of the sheet lies within a very narrow values range, which represents a property that is advantageous for authenticity checking and also allows distinguishing between correlating and non-correlating systems. Likewise, the correlation can be detected at the microscopic level, i.e. for single particles. For this purpose, one examines a single agglomerate or a group of agglomerates and checks whether they respectively show the properties of the single substances "A" and "B" employed for building up the agglomerates.

The evaluation of measuring data and determination of a statistical correlation at a multiplicity of measurement points will be described in detail hereinafter in connection with FIG. 5.

For the evaluation of measuring data and the determination of the presence or absence of a statistical correlation, different mathematical methods can be used.

Instead of "statistical correlation" one can also speak of a "statistical dependence". In this case it is checked whether there is pixel-wise a statistical dependence between the intensity "A" and the intensity "B" (yes/no decision).

There can in particular be defined quantitative measures that state how strong the pixel-wise statistical dependence between intensity "A" and intensity "B" is. In this manner, sorting classes can be defined. There are numerous textbook methods for rating the strength of the dependence on random variables. The book, W. H. Press: "Numerical Recipes in C—The Art of Scientific Computing", Cambridge University Press, 1997, pages 628-645, whose disclosure is included herein by reference, describes e.g. the following methods:

Three data types: "nominal" (general classes, e.g. red, yellow); "ordinal" (ordered classes, e.g. good, medium, poor); "continuous" (continuous measurement values, e.g. 1.2, 3.5, 2.7). "Nominal" is the most general, "continuous" the most specific.

1. Continuous

Correlation, specifically linear correlation (correlation coefficient according to Bravais-Pearson). This type of calculation is suitable in particular with two-dimensional normal distributions. It is preferred to previously remove signal outliers from the statistics via quantiles.

2. Ordinal

Rank-order method: Carry out the calculations, not on the original values, but on the rank-order indices.

a) Spearman rank correlation coefficient: the above correlation coefficient according to Bravais-Pearson applied to the rank-order indices.

b) Kendall's tau: Examines how often the rank order is retained in all pairs of data points.

These methods are suitable for arbitrary distributions. In particular, signal outliers have no disturbing effect here.

3. Nominal

Evaluations based on contingency tables (i.e. tables with the absolute or relative frequencies of events with discrete (i.e. non-continuous) values).

a) Chi square evaluation for checking whether there is a statistical dependence.

b) Entropy-based evaluation. Example: Symmetric uncertainty coefficient.

Upon the application of these methods it is preferred to previously classify the two-dimensional real measurement values into two-dimensional classes via class intervals and to establish the two-dimensional frequencies (contingency table).

Further reading on the above topic: R. Storm: "Wahrscheinlichkeitsrechnung, mathematische Statistik and statistische Qualitätskontrolle" ["Probability theory, mathematical statistics and statistical quality control"], Carl Hanser Verlag, 12th edition, 2007, pages 246-285, whose disclosure is included herein by reference.

Further information on the above topic is obtainable on the Internet on the following pages:

http://en.wikipedia.org/wiki/Correlation_and_dependence http://en.wikipedia.org/wiki/Spearman%27s_rank_correlation_coefficient http://de.wikibooks.org/wiki/Mathematik:_Statistik:_Korrelationsanalyse http://de.wikipedia.org/wiki/Rangkorrelationskoeffizient For the sake of better comprehension, two statistical methods for evaluation will hereinafter be described by way of example.

$$Kor(X, Y) = \frac{\mathrm{Cov}(X, Y)}{\sigma_X \cdot \sigma_Y} = \frac{\frac{1}{n}\sum_{i=1}^{n}(x_i - \mu_X)\cdot(y_i - \mu_Y)}{\sigma_X \cdot \sigma_Y}$$

EXAMPLE 1

The Following Correlation Function

It provides a positive contribution when two data points of a row are simultaneously located above or below the respective average thereof, i.e. two "high" or two "low" signal intensities of "A" and "B" are located at the same location.

According to one embodiment, for rating the authenticity of a value document the above correlation function can be computed for the obtained measurement values and its amount compared with a threshold value. In particular, an existing statistical correlation and thus authenticity is recognized when the amount is >0.3, preferably >0.5, and particularly preferably >0.7.

EXAMPLE 2

Figure 5:
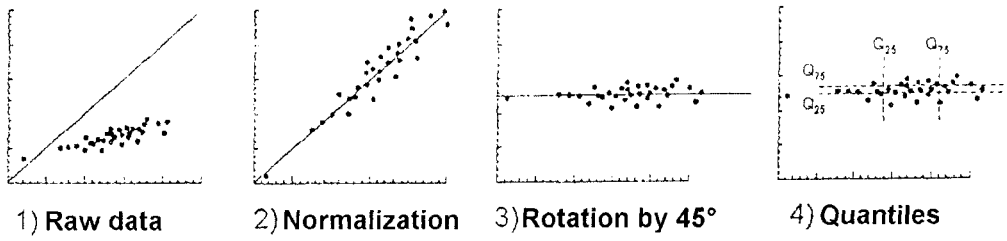
FIG. 5 schematically shows an evaluation of measuring data and deternineation of a statistical correlation at a multiplicity of measurement points.

Method having a plurality of steps, with the aim of evaluating the length-to-width ratio of the point clouds obtained from the measuring data (see FIG. 5). To minimize the influence of "outliers", 25% of the highest and lowest signal values were ignored, respectively. Correlating point clouds are elongated and possess a very pronounced length-to-width ratio, while non-correlating point clouds have a length and width that are about equally great.

According to one embodiment, for rating the authenticity of a value document one can proceed as follows: In a first step, the measuring data of the two spectroscopic methods (which might be identical) are obtained. In a second step, the measuring data are normalized. In a third step, there is performed a transformation of the axes of coordinates, preferably a rotation by 45°, in order to minimize the scattering of the data points along an axis of coordinates. In a fourth step, there are determined the quantiles in the direction of the two new axes of coordinates, preferably the quartiles, and their mutual distances or differences put in a ratio. By a comparison of said ratio with previously determined threshold values the authenticity of the value document is determined.

The value document according to the invention can additionally have in the region of the non-luminescent encoding a print, a watermark and/or a security element on the basis of a security patch or of a security strip. Such additional security elements are factors that disturb the correct evaluation of the statistical correlation or cause an additional correlation effect that is not caused by the special build-up of the particulate agglomerate according to the invention. Included here are all factors that change the signal strength of the two measurement signals to be evaluated at the same place in the paper substrate. This may be e.g. an attenuation or amplification which is to be ascribed to one of the following causes:

- a local change of thickness or density in the paper substrate, e.g. in the case of a watermark;
- an absorption of the excitation radiation for the authentication feature through a print (or an overprinting) or a security strip;
- an additional emission radiation deriving from a print (or an overprinting) or a security strip.

Figure 6:
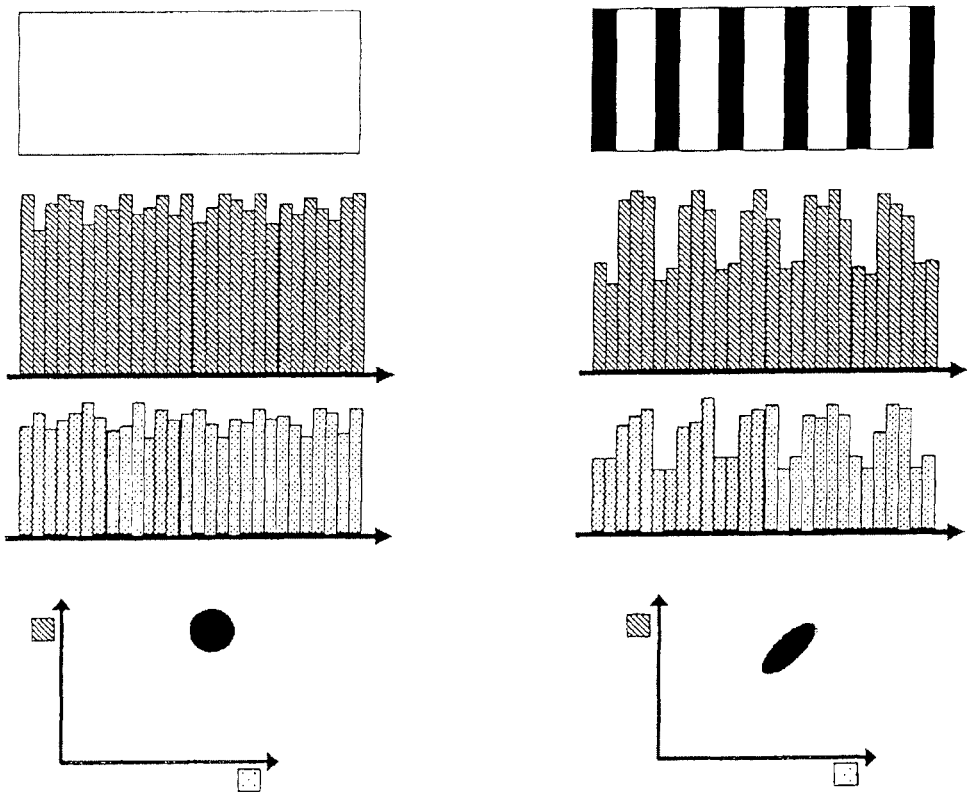
FIG. 6 schematically shows a comparison between measurement signals of two non-correlating feature substances in an unprinted paper substrate and after overprinting with a stripe pattern.

FIG. 6 shows a comparison between the measurement signals of two non-correlating feature substances in an unprinted paper substrate and after overprinting with a stripe pattern. For the following explanation it will further be assumed that the overprinting lowers the signal intensity of the two employed features, e.g. through absorption of the radiation employed for excitation. In the unprinted paper substrate, as expected, there is no noticeable relation between the signal strengths of the two feature substances. After the overprinting, however, there is an attenuation of the signal at the overprinted places, which causes a spatial correlation of the signal intensities of the two feature substances. There thus arises a similar effect as is obtained by the use of the particulate agglomerates according to the invention. Consequently, it is difficult to distinguish clearly between "normal" features, i.e. ones not according to the invention, and features according to the invention. Two ways will hence be specified hereinafter by way of example for eliminating or reducing such unwanted correlation effects caused by overprinting or the like:

Correction Method 1:

There is introduced into the value document in uniform concentration an additional ("third") component luminescing at a certain emission wavelength or detectable separately with the spectroscopic method, said component being non-correlating (correction component). Introducing a suitable, third non-correlating component and normalization through its signal intensity cause e.g. all of the above-described disturbing effects to vanish. Especially suitable luminescent substances here are those that have especially small, or ideally no, location-dependent fluctuations of luminescence intensity in an unmodified paper substrate, i.e. would possess a spatially homogeneous luminous intensity without additional influences. Applied to the example specified in FIG. 6, this would mean that the periodic attenuation by the overprinted stripe pattern accordingly influences the third component as well as the first two feature substances. Since the extent of "attenuation" by external effects is known via the third homogeneous component, the initial states of all other components can be calculated back. This method thus eliminates all correlation effects that act on all three components equally, including overprinting and differences of thickness in the substrate, depending on the case of application, but has no influence on correlation effects that only concern certain components. In this manner, there is no influence on the agglomeration-based correlation effects according to the invention.

Correction Method 2:

When it is undesirable to introduce the above-mentioned, third component e.g. for reasons of cost, other methods can also be used, depending on the case of application. When the measurement-signal intensity in an unmodified paper substrate is e.g. ordinarily above a certain threshold value and is only brought below said threshold value by overprinting effects or changes of thickness in the paper substrate, etc., corresponding data points can be eliminated from the analysis. This method is suited particularly well for cases with abrupt and strong changes of intensity, e.g. in the case of overprinting with sharply defined lines and regions, but not as well for gradual color gradations with smooth transitions, or filigree patterns. When the measured regions lie close together locally it is advantageous to likewise eliminate all neighboring measurement points when the threshold value is undershot at one measurement point (see FIG. 7). This excludes partly overprinted measured regions at the boundary of an overprinted region, even when their intensities lie above the threshold value due to the only incomplete overprinting.

Figure 7:
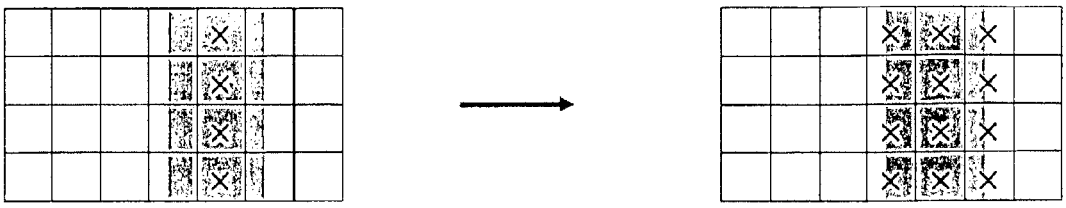
FIG. 7 schematically shows how overprinted measured regions below an intensity threshold value are excluded.

FIG. 7 shows how overprinted measured regions below an intensity threshold value are excluded (designated with x's in the figure). Subsequently, the neighboring regions are likewise excluded.

The particulate agglomerates according to the invention will be described hereinafter in connection with FIG. 8 with reference to preferred embodiments.

In principle, a number of manufacturing methods are suitable for producing the particulate agglomerates according to the invention starting out from a first non-luminescent feature substance and a second non-luminescent feature substance (and optionally one or more further luminescent or non-luminescent feature substances). Normally, the particles previously present in single form are caused to congregate into a greater unit. The thus obtained greater unit is subsequently so fixed that the particles can no longer separate from each other during application as a security feature. It is decisive here that the greater units contain parts of the two (or the three or more) feature substances that are equal as far as possible, whereby most manufacturing methods yield a random statistical mixture of the particles.

It is undesirable for like particles to congregate, so that the agglomerates only contain a single kind of particle. This can happen e.g. when the different feature substances are insufficiently intermixed before the congregation process, or the congregation of like-kind substances is promoted by surface effects or the like. However, such effects are negligible normally, or when the synthesis procedures are performed correctly.

An important factor is the sizes of the particles that build up the agglomerate, as well as the size of the arising agglomerate itself. For applications as a security feature in the bank-note sector, the agglomerates should not exceed a grain size of 30 μm, so as, inter alia, to impede recognition of the agglomerate particles in the paper substrate. However, larger grain sizes may be necessary for a certain application. Preferably, the grain size (D99) of the agglomerates hence lies in the range of 1 to 100 μm, particularly preferably 5 to 30 μm, very particularly preferably 10 to 20 μm.

If distinctly larger particles are required, e.g. due to a very extensive measurement spot area in the case of application, there can be employed, instead of the described particle agglomerates, macroscopic carrier bodies in which the different feature substances are incorporated, for example planchets or mottling fibers. Said carrier bodies can then have sizes over 100 μm, e.g. have sizes in the millimeter range, in individual or all space dimensions.

The particles of which the agglomerate is composed should be distinctly smaller than the agglomerate, since with decreasing size a higher number of particles per agglomerate can be incorporated. A higher number of incorporated particles in turn increases the probability of finding a "suitable distribution" of the two particle types in the agglomerate.

By this is meant the following relation: If the starting substance were so great that only three particles of the substances A and B in each case could form an agglomerate without exceeding the maximum agglomerate size, the combinations 'AAA'/'AAB'/'ABB'/'BBB' would be conceivable. However, such a composition would be completely unsuitable for the use according to the invention. For 25% of the agglomerates would only consist of a single substance (AAA or BBB) and thus not produce a correlation, while one third of the other 75% would be one substance and two thirds thereof the second substance, thus producing only poor correlation values.

Imagining the opposite extreme case of an agglomerate built up of 10000 (or "infinitely many") single particles, the probability of all particles accidentally being identical is arbitrarily small. When equal quantities of the two kinds of particle are used for synthesis, the mixing ratio in the agglomerates manufactured therefrom will also amount to 50% or hardly deviate therefrom. Such agglomerates would thus be well suited for use as the feature according to the invention.

In practice, one is frequently somewhere between these two extremes. The reduction of the particle size usually leads with luminophores to a noticeable loss of the measurement-signal intensity. Particularly as of a grain size of approx. 1 μm, many luminescent feature substances show a distinct intensity loss, which is usually to be ascribed to the enlargement of the surface, since energy can be dissipated non-radiatively on surface defects here. Certain non-luminescent feature substances also react disadvantageously to distinctly increased particle surfaces. An excessive grain size, however, leads to the above-described problems in the manufacture of suitable agglomerates.

As feature substances for building up the agglomerates, it is hence preferable to use small to medium-sized particles, e.g. with a grain size between 1 and 5 μm.

It should be mentioned, however, that if suitably intensive feature substances with a small particle size, e.g. in the nanometer range, are available, these could likewise be used.

The quantity ratio of the two substances A and B from which the agglomerates are manufactured amounts ideally to 1:1, if the two substances possess the same intensity and grain size. In the case of application it may be advantageous to adapt said ratio e.g. if there are great differences in signal strength or different grain-size distributions. Likewise, it may perhaps be necessary to adapt the quantity ratio in order e.g. to produce a certain desired average intensity ratio of the two signals in the end product.

Figure 8A:
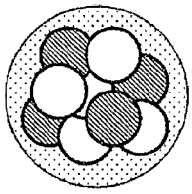
FIGS. 8(*a*)-(*e*) schematically shows examples of reference to particulate agglomerates.
Figure 8B:
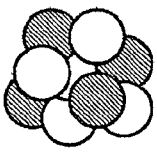
Figure 8C:
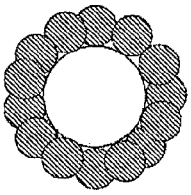
Figure 8D:
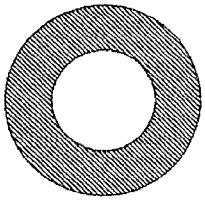
Figure 8E:
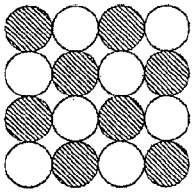

The units designated as "agglomerates" are, according to one variant, a disordered heap of mutually adherent particles which have been fixed or permanently "stuck together" (see FIGS. 8*a* and *b*). This can be done e.g. by encasing with a polymer layer or silica layer (see e.g. WO 2006/072380 A2), or by linking the particle surfaces with each other via chemical groups, etc. Such agglomerates are relatively easy to manufacture technically and are hence preferred. According to a further variant, the particles can have another build-up without losing functionality (see FIGS. 8*c, d* and *e*). Alternative embodiments, such as ordered agglomerates or core-shell systems, may perhaps possess advantageous properties (e.g. a controlled particle distribution). However, their synthesis is usually more elaborate.

In FIG. 8 are shown with reference to the particulate agglomerates the following examples:

(a) disordered feature-substance agglomerate having two different (in particular mutually adherent) feature substances and being encased or encapsulated with a polymer layer or silica layer;
(b) disordered feature-substance agglomerate having two different, mutually adherent feature substances;
(c) core-shell particles in which the core is formed by a first feature substance and the shell is formed by a plurality of second feature substances;
(d) core-shell particles in which the core is formed by a first feature substance and the continuous, homogeneous shell is formed of a second material;
(e) ordered feature-substance agglomerate having two different feature substances.

In principle, the particulate agglomerates employed according to the invention can be incorporated in the value document itself, in particular in the paper substrate. Additionally or alternatively, the particulate agglomerates can be applied, e.g. imprinted, on the value document. The value-document substrate need not necessarily be a paper substrate, but might also be a plastic substrate or a substrate having both paper constituents and plastic constituents.

The invention will hereinafter be explained more closely with reference to embodiment examples.

<Embodiment Example 1>

As a Raman-active substance there is employed the polydiacetylene from Example 12 of the print U.S. Pat. No. 5,324,567. As an ESR-active substance there is employed a strontium titanate doped with 1000 ppm manganese, as is described in the print U.S. Pat. No. 4,376,264. Both substances are present as particles with average grain sizes in the range of 1-5 μm.

For manufacturing agglomerates, the two substances are treated as follows:

5 g of the Raman-active substance and 5 g of the ESR-active substance are dispersed in 60 g water. There are added 120 mL ethanol and 3.5 mL ammonia (25%). While stirring with a vane stirrer, 10 mL tetraethyl orthosilicate is slowly added and the reaction mixture is stirred for eight more hours. The product is filtered off, washed twice with 40 mL water and dried at 60° C. in a drying oven. There are obtained particle agglomerates with a grain size D99=20-30 μm. The obtained agglomerates are treated with an ultra centrifugal mill. There is obtained a product with a reduced grain size D99=15-18 μm.

The manufactured agglomerates are subsequently so added to the paper pulp during sheet production that the agglomerates are contained in the resulting sheet with a mass fraction of 0.1 percent by weight.

At a plurality of different places of the sheet the intensity of the signal of the respective security features is established (intensity of Raman signal and intensity of ESR signal). The measured signal intensities of the two different security features correlate with each other.

<Embodiment Example 2>

As an ESR-active substance there is employed a strontium titanate doped with 1000 ppm manganese, as is described in the print U.S. Pat. No. 4,376,264. As a SERS-active substance there are employed the silica-coated BPE-loaded (BPE=trans-4,4'-bis(pyridyl)ethylene) gold particles from Example 1 of the print US 2011/0228264 A1. Both substances possess average grain sizes under 5 μm.

16.5 g of the ESR-active substance and 16.5 g of the SERS-active substance are dispersed in 245 g water. There is added 44 g potassium hydrogencarbonate, and a potassium water glass solution added in drops while stirring over the course of one hour, so that approx. 15 g $SiO_2$ is deposited on the agglomerates. The product is filtered off, washed twice with 150 ml water and dried at 60° C. in a drying oven. There are obtained particle agglomerates with a grain size D99=18-20 μm.

The manufactured agglomerates are subsequently so added to the paper pulp during sheet production that the agglomerates are contained in the resulting sheet with a mass fraction of 0.1 percent by weight.

At a plurality of different places of the sheet the intensity of the signal of the respective security features is established (intensity of ESR signal and intensity of SERS signal). The measured signal intensities of the two different security features correlate with each other.

Alternatively or additionally, a single-particle analysis can be carried out. The ESR properties of a single agglomerate in the sheet can be examined e.g. with a suitable ESR microscope. The SERS properties of a single agglomerate can be examined for example by a suitable TERS setup (tip-enhanced Raman spectroscopy) or a Raman microscope. In the single particles of the manufactured agglomerates there can be detected both the specific ESR properties and the specific SERS properties of the security features used as educts.

<Embodiment Example 3>

As a first zero field-active substance there is employed a manganese ferrite as is described in Example 2 of the print WO 96/05522 A. As a second zero field-active substance there is employed an isotope-labeled yttrium oxychloride. The employment of isotope-labeled chlorine-containing substances as zero field-active security features is described in general in print WO 03/014700 A2. Both substances possess average grain sizes under 5 μm.

16.5 g of the first zero field-active substance and 16.5 g of the second zero field-active substance are dispersed in 245 g water. There is added 44 g potassium hydrogencarbonate, and a potassium water glass solution added in drops while stirring over the course of one hour, so that approx. 15 g $SiO_2$ is deposited on the agglomerates. The product is filtered off, washed twice with 150 ml water and dried at 60° C. in a drying oven. There are obtained particle agglomerates with a grain size D99=18-20 μm.

The manufactured agglomerates are subsequently so added to the paper pulp during sheet production that the agglomerates are contained in the resulting sheet with a mass fraction of 0.1 percent by weight.

At a plurality of different places of the sheet the intensity of the respective NQR signal of the two security features used as educts is established. The measured signal intensities of the two security features correlate with each other.

The invention claimed is:

1. A value document comprising particulate agglomerates respectively containing at least two different homogeneous phases, wherein the first homogeneous phase is based on a first non-luminescent substance detectable by a spectroscopic method and the second homogeneous phase is based on a second non-luminescent substance detectable by a spectroscopic method, and wherein upon an evaluation of measurement values that are obtainable by a location-specific measurement, carried out at different locations of the value document, of the first measurement-signal intensity caused by the first substance and underlying the spectroscopic method and the second measurement-signal intensity caused by the second substance and underlying the spectroscopic method, there is a statistical correlation between the first measurement-signal intensities and the second measurement-signal intensities;

wherein the spectroscopic method suitable for the detectability of the first non-luminescent substance and the spectroscopic method suitable for the detectability of the second non-luminescent substance are identical, wherein preferably the exciting electromagnetic radiation of the spectroscopic method is radio-wave, microwave, terahertz or infrared radiation;

wherein the non-luminescent substance of the first homogeneous phase and the non-luminescent substance of the second homogeneous phase are chosen from the following five kinds of substance, namely, a substance detectable by nuclear magnetic resonance spectroscopy, a substance detectable by electron spin resonance spectroscopy, a substance detectable by nuclear quadrupole resonance spectroscopy, a substance detectable by SER (surface-enhanced Raman) spectroscopy and a substance detectable by SEIRA (surface-enhanced infrared absorption) spectroscopy, on the condition that the kind of non-luminescent substance of the first homogeneous phase is identical with the kind of non-luminescent substance of the second homogeneous phase.

2. The value document according to claim 1, wherein the agglomerates are chosen from the group consisting of core-shell particles, particle agglomerates, encapsulated particle agglomerates and nanoparticle-encased particles.

3. The value document according to claim 1, wherein the particulate agglomerates have a grain size D99 in a range of 1 micrometer to 100 micrometers.

4. The value document according to claim 1, wherein, in addition to the particulate agglomerates, there is incorporated into or applied to the value document in uniform concentration a non-correlating correction component which luminesces at a certain emission wavelength or is detectable separately with one of the spectroscopic methods.

5. A method for checking the presence or the authenticity of a value document according to claim 1 comprising:

a) exciting the non-luminescent substance, detectable by a spectroscopic method, of the first homogeneous phase and exciting the non-luminescent substance, detectable by a spectroscopic method, of the second homogeneous phase;

b) spatially resolved capturing of measurement values for the first measurement-signal intensities and second measurement-signal intensities deriving from the non-luminescent substances and underlying the respective spectroscopic method, in order to generate first measurement-signal intensity/location measurement-value pairs and second measurement-signal intensity/location measurement-value pairs;

c) checking whether there is a statistical correlation between the first measurement-signal intensities and the second measurement-signal intensities.

6. The method according to claim 5, wherein the measurement values for the first measurement-signal intensities and second measurement-signal intensities deriving from the non-luminescent substances and underlying the respective spectroscopic method are converted into corrected measurement values in an intermediate step.

7. The method according to claim 5, wherein only those measurement values for the first measurement-signal intensities and second measurement-signal intensities deriving from the non-luminescent substances and underlying the respective spectroscopic method that respectively lie within a certain values range, above a certain threshold value, are drawn on for determining authenticity.

8. A method for checking the presence or the authenticity of a value document according to claim 1 comprising:

a) exciting the non-luminescent substance, detectable by a spectroscopic method, of the first homogeneous phase and exciting the non-luminescent substance, detectable by a spectroscopic method, of the second homogeneous phase;

b) spatially resolved capturing of measurement values for the first measurement-signal intensities and second measurement-signal intensities deriving from the non-luminescent substances and underlying the respective spectroscopic method, at at least one location of the value document;

c) checking whether the ratio, measured at the at least one location of the value document, of the measurement values for the first and second measurement-signal intensities lies within a certain values range.

9. The method according to claim 8, wherein the measurement values for the first measurement-signal intensities and second measurement-signal intensities deriving from the non-luminescent substances and underlying the respective spectroscopic method are converted into corrected measurement values in an intermediate step.

10. The method according to claim 8, wherein only those measurement values for the first measurement-signal intensities and second measurement-signal intensities deriving from the non-luminescent substances and underlying the respective spectroscopic method that respectively lie within a certain values range, above a certain threshold value, are drawn on for determining authenticity.

11. A method for checking the presence or the authenticity of a value document according to claim 1 comprising:

a) exciting the non-luminescent substance, detectable by a spectroscopic method, of the first homogeneous phase in one or more of the particulate agglomerates;

b) exciting the non-luminescent substance, detectable by a spectroscopic method, of the second homogeneous phase in one or more of the particulate agglomerates, with the examined particulate agglomerates being identical with the particulate agglomerates examined in a);

c) checking whether the at least one examined particulate agglomerate has both the measurement signal of the first non-luminescent substance and the measurement signal of the second non-luminescent substance.

12. The method according to claim 11, wherein one or more microscope setups are used for checking the properties of the non-luminescent substances.

13. A value document comprising particulate agglomerates respectively containing at least two different homogeneous phases, wherein the first homogeneous phase is based on a first non-luminescent substance detectable by a spectroscopic method and the second homogeneous phase is based on a second non-luminescent substance detectable by a spectroscopic method, and wherein upon an evaluation of measurement values that are obtainable by a location-specific measurement, carried out at different locations of the value document, of the first measurement-signal intensity caused by the first substance and underlying the spectroscopic method and the second measurement-signal intensity caused by the second substance and underlying the spectroscopic method, there is a statistical correlation between the first measurement-signal intensities and the second measurement-signal intensities;

wherein the first spectroscopic method suitable for the detectability of the first non-luminescent substance and the second spectroscopic method suitable for the detectability of the second non-luminescent substance are different, wherein the exciting electromagnetic radiation of the first spectroscopic method and the exciting electromagnetic radiation of the second spectroscopic method are chosen from the following four kinds of radiation, radio-wave, microwave, terahertz and infrared radiation, on the condition that the kind of exciting electromagnetic radiation of the first spectroscopic method is different from the kind of exciting electromagnetic radiation of the second spectroscopic method.

14. The value document according to claim 13, wherein the non-luminescent substance of the first homogeneous phase and the non-luminescent substance of the second homogeneous phase are chosen from the following five kinds of substance, namely, a substance detectable by nuclear magnetic resonance spectroscopy, a substance detectable by electron spin resonance spectroscopy, a substance detectable by nuclear quadrupole resonance spectroscopy, a substance detectable by SER (surface-enhanced Raman) spectroscopy and a substance detectable by SEIRA (surface-enhanced infrared absorption) spectroscopy, on the condition that the kind of non-luminescent substance of the first homogeneous phase is different from the kind of non-luminescent substance of the second homogeneous phase.

* * * * *